United States Patent [19]

Price et al.

[11] 4,229,279

[45] Oct. 21, 1980

[54] ELECTROPLATING ELECTRODE AND METHOD OF MOUNTING AN ARTICLE TO BE PLATED THEREON

[75] Inventors: Frank B. Price, Jefferson County; Mathieu J. Vertenstein, Denver, both of Colo.

[73] Assignee: Silver Engineering Works, Inc., Denver, Colo.

[21] Appl. No.: 71,758

[22] Filed: Aug. 31, 1979

[51] Int. Cl.[2] ..... C25C 7/00; C25C 7/02

[52] U.S. Cl. ..... 204/297 R; 204/216; 204/213

[58] Field of Search ..... 204/212, 213, 216, 297 R, 204/286, 289

[56] References Cited

U.S. PATENT DOCUMENTS

| | | | |
|---|---|---|---|
| 1,736,857 | 11/1929 | McCord | 204/216 |
| 3,817,843 | 6/1974 | Barrett | 204/216 X |
| 4,043,876 | 8/1977 | Hambling et al. | 204/216 X |
| 4,169,033 | 9/1979 | Dunagan | 204/289 X |

*Primary Examiner*—Arthur C. Prescott

*Attorney, Agent, or Firm*—Edwin L. Spangler, Jr.

[57] ABSTRACT

This invention relates to an electroplating electrode characterized by a drum having a longitudinally-extending groove therein that constitutes the groove of a first tongue and groove connector, the tongue of which comprises a second tongue and groove connector adapted for insertion into the groove of the first. The invention also encompasses the method of mounting an article to be plated on the drum of such an electrode which includes the steps of preshaping the article to define a drum-encircling portion thereof bearing a precise predetermined dimensional relationship to the outer circumference of the drum, clamping the edges of said article bordering said drum-encircling portion in the second of the two tongue and groove connectors to establish a continuous current path therearound, placing the endless loop thus formed around the drum of the electrode and depressing the tongue of the first tongue and groove connector defined by the second into the groove of the first to bring that drum-encircling portion of the article to be plated into intimate conductive contact.

10 Claims, 4 Drawing Figures

Fig.-2
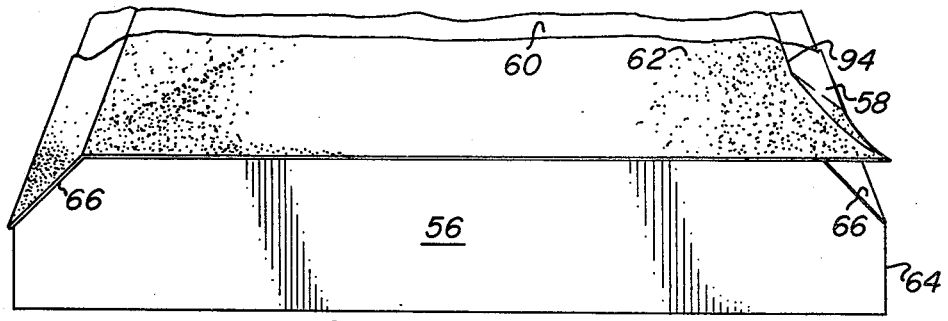
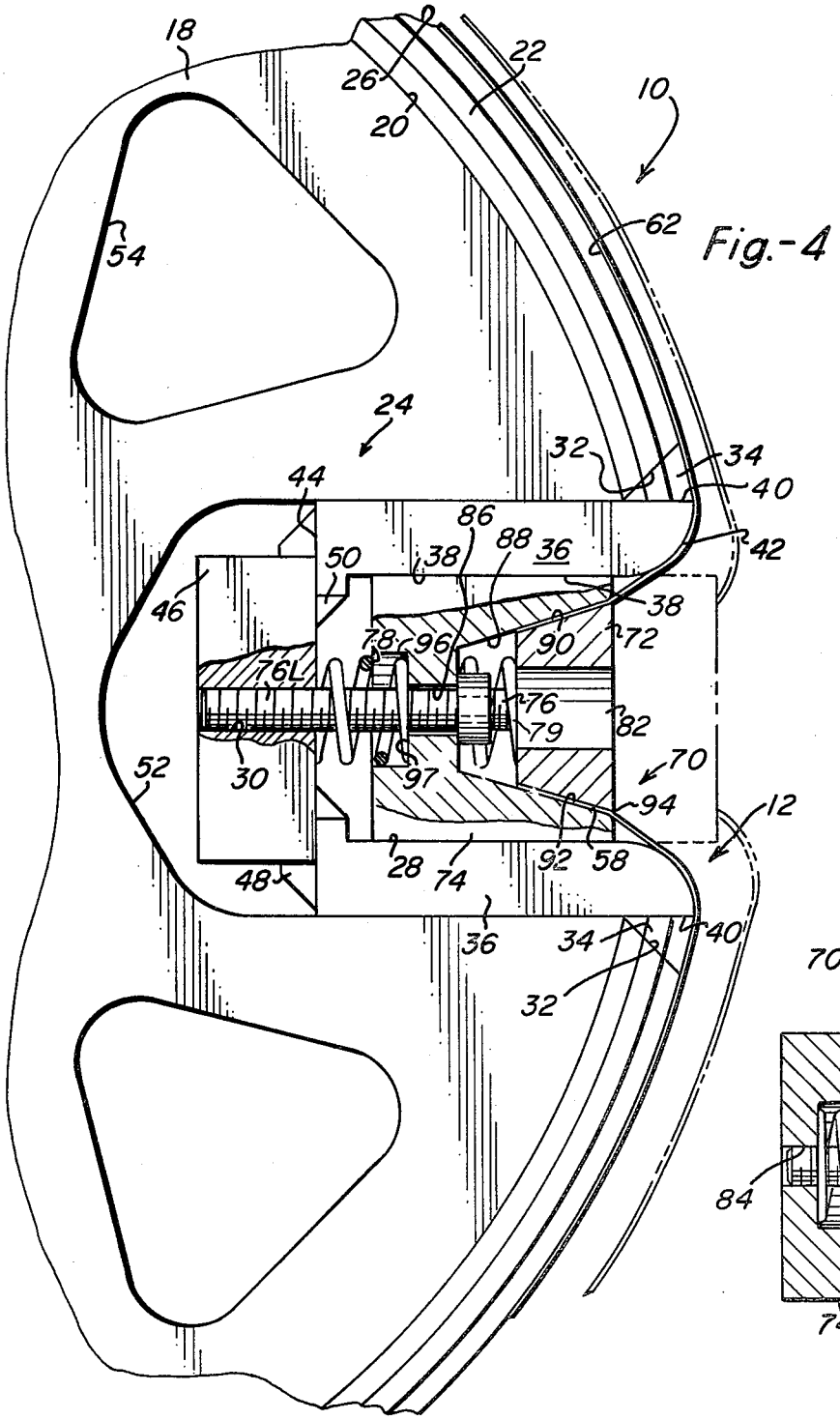
Fig.-4
Fig.-3
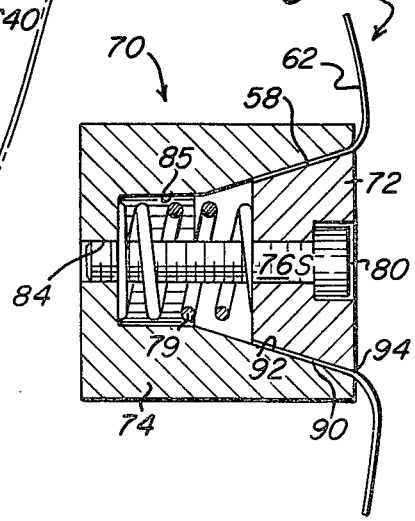

ELECTROPLATING ELECTRODE AND METHOD OF MOUNTING AN ARTICLE TO BE PLATED THEREON

The sugar industry uses high speed centrifuges containing a bowl lined with a screen made from No. 316 Stainless Steel. The holes in these screens are minute, being on the order of a few thousandths of an inch in diameter and having a generally frustoconical shape. These screens frequently contain several million such holes produced by a complex etching process. The resulting screens are quite expensive and, for this reason, must be kept in service for as long a period of time as possible. Unfortunately, the mixture fed into a sugar centrifuge is exceedingly abrasive in nature and the screens tend to wear out quite rapidly unless steps are taken to coat or otherwise protect their wearing surfaces.

For some time now, the traditional method employed to reduce wear has been to chromeplate the wearing surfaces using more or less standard electroplating techniques. While the chemistry of the plating process has remained virtually unchanged, the physical problems associated with mounting the screen to produce a uniform plated surface have not since such uniformity has proven to be most difficult to achieve.

The early attempts at plating these screens took the form of mounting them in a rectangular frame of some sort and fastening the electrodes to the opposite corners of the latter. This technique proved to be most unsatisfactory because the current density was not the same all the way across the screen and the resulting plate was both uneven and non-uniform. Since that time, essentially all centrifuge screens have been plated by wrapping them around a cylindrical mandrel which constitutes one of the electrodes. The uniformity of the plate increased dramatically using this mounting technique provided the screen lay in intimate contact with the cylindrical surface of the mandrel; otherwise, the results were quite poor. At first glance, wrapping the screen tightly around the drum-like mandrel and connecting its free ends together seems like a simple enough procedure but it has proven to be a very difficult one, so difficult in fact that up until now no satisfactory solution to the problem has been found. The reason this seemingly simple task has proven so troublesome appears to be that the prior art practitioners have attempted to combine the tightening and end-connecting functions into a single operation. More specifically, the current prior art practice is to provide the mandrel drum with a pair of longitudinally-extending parallel grooves arranged in spaced relation alongside one another. The free ends of the screen are then brought into juxtaposed position in the gap between the grooves and a double-tongued key inserted to both provide for current carrying continuity therebetween and, at the same time, force the screen down into the groove to tighten same. About three instances out of four, this technique works fine but the remainder of the time the screens are so poorly plated that they have to be done over.

It has now been found in accordance with the teaching of the instant invention that these and other shortcomings of the prior art screen mounting techniques for electroplating purposes can, in large measure, be eliminated by the simple, yet unobvious expedient of first fastening the screen ends together and then tightening the assembly thus formed around the drum-like mandrel. The screen is first cut to approximate size preparatory to preshaping the free ends thereof in a precise fixed-spaced predetermined relationship to one another. Once thus preshaped, the ends of the screen are brought together and clamped securely in an elongate interlocking tongue and groove type clamp subassembly. This clamp cooperates with the screen itself to establish a continuous loop of precise circumference closely matched to that of the mandrel drum. The loop thus formed is then slipped over the drum preparatory to tightening same thereon by merely drawing the clamp subassembly down into a deep groove in the drum using a series of screw fasteners. If the screen is properly preshaped and the clamp fastened to its preshaped ends at the proper place, the resulting loop will engage the drum of the mandrel in a manner to insure a near optimal plating job every time.

It is, therefore, the principal object of the present invention to provide a novel and improved electroplating material of a type especially well suited for use in chromeplating screens for sugar centrifuges.

A second objective is the provision of a method for mounting screens to be electroplated that includes as separate steps those of first fastening the free ends together and secondly tightening the endless assembly thus formed securely around the drum-like electrode so as to establish intimate current carrying contact therebetween.

An additional object of the within described invention is that of using a first tongue and groove subassembly as the means for fastening the screen ends together and then using the first tongue and groove subassembly as the tongue in a second tongue and groove subassembly which is employed to tighten the screen loop thus formed about a cylindrical electrode.

Another objective is the provision of an apparatus of the type mentioned above wherein the elements of each of the two tongue and groove subassemblies are spring-biased apart to facilitate disassembly thereof.

Still another object is that of providing a method and apparatus for mounting centrifuge screens that can be relied upon to establish and maintain current continuity throughout the plating operation.

Further objects of the invention forming the subject matter hereof are those of providing a screen-mounting electrode which is simple, inexpensive, easy to use, virtually foolproof, rugged, versatile, and easy to service and maintain.

Other objects will be in part apparent and in part pointed out specifically hereinafter in connection with the description of the drawings that follows, and in which:

FIG. 2 is a fragmentary perspective view to a reduced scale showing the fixture used to preshape the screen and a screen being preshaped thereon;

FIG. 3 is a fragmentary sectional view showing the manner in which the preshaped screen is clamped within the clamp subassembly; and, FIG. 4 is a fragmentary section to the same scale as FIG. 3 showing the clamp subassembly and preshaped screen being drawn snugly around the mandrel shell.

Figure 1:
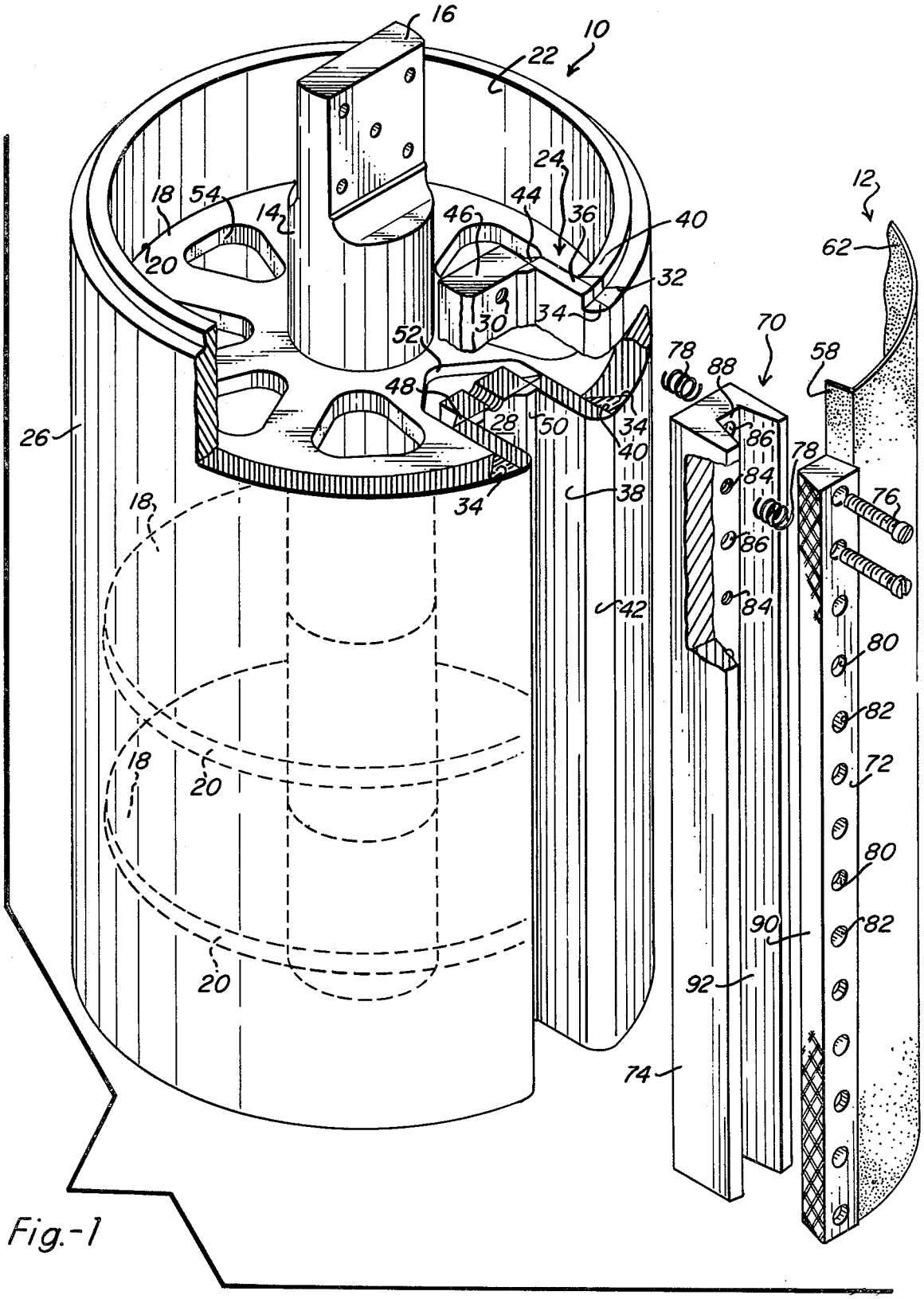
FIG. 1 is an exploded perspective view showing the elements of the mandrel and the preshaped screen preparatory to being assembled, portions of the shell having been broken away and shown in section to more clearly reveal the interior construction.

Referring next to the drawings for a detailed description of the present invention and, initially, to FIG. 1 for this purpose, reference numeral 10 has been selected to designate the hollow drum-like screen plating mandrel in a general way while numeral 12 similarly refers to the screen being plated. The mandrel 10 includes an axially-extending rod-like centerpost 14 fabricated from metal and having the upper end 16 thereof shaped for connection to a copper hanger (not shown) that constitutes the cathode of the plating assembly. Two or more circular metal discs 18 are stacked one above another in axially-spaced relation on centerpost 14 to which they are welded so as to preserve the current carrying continuity of the mandrel. These discs define radial flanges, the circumferential outside edges 20 of which lie in concentric relation to the centerpost in the particular form shown. These same edges define supports for cylindrical shell 22 which encircles the discs and is welded thereto in much the same manner and for the same purpose that the discs are welded to the centerpost, i.e. both for structural and for current carrying purposes.

Shell 22 together with a three-piece groove-forming subassembly broadly indicated by reference numeral 24 are welded together to form a unitary drum 26 by means of which plating current can be conducted from centerpost 14 all the way out to the surface of the shell against which the screen 12 lies. The outer cylindrical surface of shell 22 is machined smooth so as to provide intimate face-to-face contact with the opposed inside surface of screen 12 when the latter is preshaped into the essentially split tubular form necessary to encircle the mandrel. The most significant single feature of the shell is its single longitudinally-extending groove 28 and the series of threaded holes 30 in the bottom thereof, the purpose of which will be set forth in detail presently. Groove 28 opens outwardly and might, for example, be something over two inches wide in a mandrel of between 15 and 16 inches in outside diameter.

Directing the attention to FIG. 4, the groove-forming subassembly 24 and the manner of its attachment to shell 22 will be set forth in detail. Shell 22 is in the form of a longitudinally-split tube. Bias cut surfaces 32 bordering this slit are joined by welds 34 to plates 36. Plates 36 have their inner flat surfaces 38 arranged in essentially-spaced parallel relation. The V-shaped groove between the outside surfaces 40 of the plates and bias cut surfaces 32 of the split tube receive the welds 34. The corners of the plates leading into groove 28 are radiused as shown at 42.

The edges 44 of the plates nearest centerpost 14 are coplanar and the gap therebetween is bridged with a crosspiece 46 that contains the threaded holes 30. Weldments 48 and 50 attach the crosspiece to the plates. Current is carried to the shell by post 14 and discs 18. Each disc 18 is notched as shown at 52 to receive the groove-forming elements just described. The other apertures 54 in the discs are provided so that the electrolyte can circulate freely through the mandrel.

Referring next briefly to FIG. 2, a fixture 56 has been shown which constitutes a suitable form over which the downturned flanges 58 bordering both side margins of screen 12 can be bent. This fixture has a large planar top surface 60, the width of which is somewhat greater than the circumferential distance around shell 22 measured from one side of the groove 28 therein to the other. The width of surface 60 is fairly critical and it should, therefore, be fabricated with sufficient accuracy such that the corresponding face 62 of the screen does not vary therefrom in width over a 1/64th of an inch or so. The sides 64 of the fixture are truncated so as to produce inclined planar surfaces 66 against which downturned marginal flanges 58 bordering both side edges of screen 12 are formed. The screen is precut to its required length and width before being laid atop fixture 56, whereupon, a mallet or other shaping tool is used to bend down flanges 58. Once these flanges are formed, the screen thus preshaped is ready to be mounted on the mandrel in the manner which is about to be described in connection with FIGS. 1, 3 and 4.

The groove 28 in groove-forming subassembly 24 is designed to receive and mate with a clamp subassembly that has been broadly designated by reference numeral 70 and which includes wedge-shaped insert 72, a channel-shaped member 74, a plurality of cap screws 76S and 76L and a like number of compression springs 78 and 79. Wedge-shaped insert 72 contains a first set of countersunk smooth-bored holes 80 and a second set of oversized smooth-bored holes 82 interspersed therebetween, the later being sized to loosely receive both the shank and head of the long cap screws 76L. The web of channel-shaped member 74 also contains two sets of holes. The first of these sets 84 is aligned with the countersunk set 80 and each is threaded to accept the threaded shank of the short cap screws 76S; whereas, the second set 86 is smooth-bored to loosely receive long screws 76L. The latter set of smooth-bored holes 86 align with the oversize set 82 in the wedge-shaped insert 72 but they are smaller so as to loosely receive the cap screw shank while defining an annular shoulder abutting the head thereof. Smooth-bored hole set 86 also lines up axially with the threaded holes 30 in the crosspiece 46 of the groove-forming subassembly 24 and the latter set of holes also threadedly receive the cap screw shanks. Crosspiece 46 contains no holes corresponding to holes 84 in the web of channel-shaped member 74 because the cap screws screwed into the latter terminate short of the bottom of trough-like flared groove 88 therein.

Now, the first operation to be performed following the preshaping of the screen 12 is that of clamping its downturned marginal flanges 58 in the clamp subassembly 70 in the manner shown most clearly in FIG. 3 to which detailed reference will now be made. Wedge-shaped insert 72 is trapezoidal in cross section and it constitutes a tapered piece shaped to fit into the flared groove 88 in the channel-shaped element 74 cooperating therewith to pinch and tightly clamp the downturned flanges 58 between the opposed inclined mating surfaces 90 and 92 thereof. In the preferred form of the invention, these mating surfaces 90 and 92 are cross-hatched or otherwise roughened to provide a better grip on the marginal flanges of the screen. The threaded shanks of cap screws 76S screw into threaded openings 84 in the web of the channel-shaped element 74 and draw the wedge-shaped member 72 ever more tightly into the flared groove 88 thus securely fastening the flanged margins of the screen into the clamp subassembly 70.

It should also be noted that bolt holes 86 in the web of the channel-shaped member 74 are counterbored to seat one of the compression springs 78 that loosely envelope the shank of cap screws 76L. The opposite ends of these springs rest atop crosspiece 46. Springs 79 have their lower ends resting on the ledge at the bottom of countersunk portion 85 above bolt hole 86. The upper ends of these springs 79 push upwardly against the underside of the wedge-shaped element so as to normally bias elements 72 and 74 apart thus facilitating disassembly of clamp subassembly 70.

When the folds 94 in the screen separating the body 62 thereof from its flanges 58 are bent tightly over the edges of the channel-shaped member 74 as revealed in FIGS. 1 and 3, the loop thus defined by the screen and clamp subassembly 70 will be large enough to pass easily around the shell 22 of the mandrel. The final step in the assembly operation is that of drawing the screen tightly against the mandrel shell so as to establish and maintain proper current conducting contact therebetween. This last operation will be described in detail in connection with FIG. 4 to which reference will now be made.

Once the screen loosely envelopes the mandrel shell, it can be slid around circumferentially to the point when the clamp subassembly 70 is longitudinally aligned with groove 28, whereupon, it is lowered down into groove 88 and secured to the base or crosspiece 46 of the groove-forming subassembly 24 with long cap screws 76L. In the particular form shown, these screws 76L pass, head and all, clear through the oversized smooth-bored openings 82 in the wedge-shaped element 72 where the heads come to rest atop the web of channel-shaped member 74. The shanks of these cap screws are also loosely received in the smooth-bored set of openings 86 and thread into threaded holes 30 in the crosspiece 46 of the groove-forming subassembly 24. As the latter set of screws is tightened, they draw the clamp subassembly 70 deeper and deeper into groove 28 of the mandrel thus tightening the screen around the shell 22 thereof and establishing intimate face-to-face contact therebetween for electroplating purposes.

Finally, FIG. 4 reveals that the bolt holes 86 in the web of channel-shaped element 74 are counterbored from the underside thereof and provide downwardly-facing annular shoulder 96 (FIG. 4) for the upper end of compression spring 78 to abut against. This spring encircles the exposed portion of the shank of bolt 76L and pushes against the crosspiece 46 to normally bias the clamp subassembly 70 out of groove 28 in the mandrel thus facilitating disassembly thereof in much the same manner as the elements of the clamp subassembly 70.

What is claimed is:

1. In a drum-like electrode for use as a mandrel to support a sheet material wrapped therearound when being electroplated: a first channel-shaped element having a longitudinally-extending groove therein; a first tongue-forming element adapted for insertion into the groove in the first channel-shaped element; and first fastener means connecting the first channel-shaped element and first tongue-forming element together to form a first clamp subassembly effective to fasten the ends of the article to be plated together and cooperate therewith to define an endless electrically-conductive loop; a hollow cylindrical shell of electrically-conductive material sized for insertion into the endless loop defined by the article to be plated and the first clamp subassembly, said shell having a longitudinally-extending slit therein of a width substantially greater than that of the first clamp subassembly; a second channel-shaped element having a longitudinally-extending groove therein sized to receive the first clamp subassembly, said second channel-shaped element being fastened in bridging relation across the slit in the shell with its groove facing outwardly; second fastener means connected between the first clamp subassembly and the second channel-shaped element operative upon actuation to draw the former down into the groove in the latter so as to tighten the article to be plated snugly against the surface of the shell; and means within the hollow interior of the shell effective to conduct an electrical current thereto upon connection to a source of electrical energy.

2. The electrode as set forth in claim 1 wherein the groove in the first channel-shaped element is flared and the tongue-forming element is tapered to mate therewith.

3. The electrode as set forth in claim 1 wherein both channel-shaped elements have a web in the bottom thereof, said webs each having a series of apertures, the apertures in one web being aligned with the apertures in the other web, the apertures in the web of the second channel-shaped element being threaded and the apertures in the web of the first channel-shaped element being oversize in relation thereto; and wherein the second fastener means comprise bolts having threaded shanks adapted for threaded engagement within the apertures in the web of the second channel-shaped element while passing loosely through the oversize apertures in the web of the first.

4. The electrode as set forth in claim 1 wherein the first channel-shaped element includes a web in the bottom thereof containing series of threaded apertures; wherein the tongue-forming element includes a series of oversize apertures aligned with the series of threaded apertures in the web of the first channel-shaped member that are larger than the latter; and wherein the first fastener means comprise bolts with threaded shanks sized to fit loosely within the series of oversize apertures in the tongue-forming element and screw into the threaded apertures in the web of the first channel-shaped element aligned therewith.

5. The electrode as set forth in claim 1 including first spring means interposed between the second channel-shaped member and the first clamp subassembly normally biasing same apart.

6. The electrode as set forth in claim 1 including second spring means interposed between the first channel-shaped element and the tongue-forming element of the first clamp subassembly normally biasing same apart.

7. The electrode as set forth in claim 3 wherein the bolts of the second fastener set have oversize heads atop the threaded shanks thereof that are larger than the oversize openings in the web of the first channel-shaped member; and wherein the tongue-forming element of the first clamp subassembly includes a series of apertures aligned with the aligned apertures in the webs of the first and second channel-shaped elements, said apertures in said tongue-forming element being sized to pass the heads of the bolts in the second set of fasteners.

8. The electrode as set forth in claim 3 wherein the oversize apertures in the web of the first channel-shaped element are counterbored from the underside thereof to define sockets; and, wherein coiled compression springs are seated within the sockets thus formed normally-biasing said channel-shaped members apart.

9. The electrode as set forth in claim 4 wherein the series of threaded apertures in the web of the first channel-shaped member aligned with the oversize series of apertures in the tongue-forming element are countersunk to define sockets; and, wherein coiled compression springs are seated within said sockets normally biasing the elements of the first clamp subassembly apart.

10. The electrode as set forth in claim 4 wherein the second channel-shaped subassembly includes a web having a series of threaded apertures therein; wherein the web of the first channel-shaped element includes a series of oversize apertures interspersed among the set of threaded apertures therein, said oversize apertures being larger than the threaded apertures in the web of the second channel-shaped element and aligned therewith; and wherein the second set of fasteners comprise bolts loosely received within the oversize apertures in the web of the first channel-shaped member and threadable into the threaded apertures in the web of the second channel-shaped member.

* * * * *